US006156129A

United States Patent [19]

Hlivka et al.

[11] Patent Number: 6,156,129

[45] Date of Patent: Dec. 5, 2000

[54] LIQUID METAL CLEANER FOR AQUEOUS SYSTEM

[75] Inventors: Linda M. Hlivka, Downingtown, Pa.; Joseph Mihelic, Sparta; Bruce L. Libutti, Teaneck, both of N.J.

[73] Assignee: Ashland Inc., Dublin, Ohio

[21] Appl. No.: 09/153,645

[22] Filed: Aug. 17, 1998

Related U.S. Application Data

[63] Continuation-in-part of application No. 08/747,872, Nov. 13, 1996, abandoned.

[51] Int. Cl.[7] ..... B08B 3/04; C11D 3/30; C11D 7/26; C11D 7/32

[52] U.S. Cl. ..... 134/42; 510/247; 510/253; 510/254; 510/477; 510/488; 510/499

[58] Field of Search ..... 510/247, 253, 510/254, 477, 488, 499; 134/42

[56] References Cited

U.S. PATENT DOCUMENTS

| | | | |
|---|---|---|---|
| 4,965,019 | 10/1990 | Schmid et al. | 510/406 |
| 5,507,971 | 4/1996 | Ouzounis et al. | 510/434 |

*Primary Examiner*—Gregory A. Delcotto
*Attorney, Agent, or Firm*—David L. Hedden

[57] ABSTRACT

The invention relates to a composition useful for cleaning metal surfaces immersed in an aqueous system. The composition comprises as a mixture: an organic carboxylic acid; a non chelating amine; a chelating agent; and preferably a sulfur-containing polymer.

9 Claims, No Drawings

LIQUID METAL CLEANER FOR AQUEOUS SYSTEM

CROSS REFERENCE TO RELATED APPLICATION

This application is a continuation-in-part of application Ser. No. 08/747,872 filed on Nov. 13, 1996, now abandoned.

FIELD OF THE INVENTION

The invention relates to a liquid composition useful for cleaning metal surfaces immersed in an aqueous system. The composition comprises as a mixture: a carboxylic acid; a non chelating amine; a chelating agent or alkali metal salt or ammonium salt thereof; and preferably a sulfur-containing polymer.

BACKGROUND OF THE INVENTION

Cooling systems remove waste heat from industrial processes through a heat transfer mechanism. Since water is the medium for removing heat from the system, metal parts in the cooling system can become corroded. Such metal parts in the cooling system may include chiller systems, heat exchangers, auxiliary equipment and system piping.

Corrosion of metal parts results from the oxidation of the metal when exposed to an oxidizing compound. Corrosion is an electrochemical process in which a difference in electrical potential (voltage)develops between two metals or between different parts of a single metal. This potential can be measured by connecting the metal to a standard electrode and determining the voltage. The potential generated can be expressed as positive or negative. A corrosion cell is then produced in which the current passing through the metal causes reactions at the anode (area of lower potential) and cathode (area of higher potential).

The following shows the sequence of events as metal becomes oxidized: (1) $Fe^0$ is lost from the anode to the bulk water solution and becomes oxidized to $Fe^{2+}$. (2) Two electrons are released through the metal to the cathode. (3) Oxygen in the water solution moves to the cathode and forms hydroxyl ions at the surface of the metal producing ferrous hydroxide.

Ferrous hydroxide precipitates quickly on the metal surface as a white floc and is further oxidized to ferric hydroxide. When these reaction products remain at the cathode, a barrier is formed that physically separates the $O_2$ in the water from the electrons at the metal surface. This process is called polarization and protects the metal from further corrosion by minimizing the potential between the anode and the cathode. Removal of this barrier, called depolarization, through lowering of the pH or by increasing the velocity of the water produces further metal oxidation and the detrimental corrosion products of ferric or iron oxide, and rust.

Prefilming or passivation of equipment is a common practice in extending the life of equipment in aqueous systems. When equipment is new, a chemical corrosion inhibitor is added initially to form an impervious film to halt corrosion. Once the protective film is formed, a small amount of a corrosion inhibitor is continuously required to maintain the film and inhibit corrosion. However, changes in a cooling system environment such as low pH excursions, process leakage, microbiological deposition, organic and inorganic fouling can cause disruption and penetration of the protective film allowing production of corrosion products.

The corrosion can manifest itself in various forms such as uniform attack, pitting or tuberculation to name a few.

Significant amounts of rust reduce heat transfer efficiency and can accelerate corrosion rates by the formation of concentration cells under the corrosion deposit. This can negatively affect the overall operation of a cooling system resulting in reduced operating efficiency, increased maintenance costs and down time as well as shortened equipment life. Once iron oxide is present in significant amounts, cleaning of the equipment to remove the corrosion products is necessary.

The current practice for years in iron oxide removal was to shut down the system and add an acid cleaner containing hydrochloric, sulfuric, sulfamic, gluconic or citric acids, reducing the pH to 3.0 to 3.5, and circulating the solution for several hours with heat. This process can be very corrosive to the base metal of equipment causing increased metal loss once the iron oxide is removed. Holes in the metal of critical equipment can be created quickly, resulting in process leakage and/or reduced operating efficiency. In addition, the handling of large amounts of strong acids can be hazardous for plant employees. Another method for removing corrosion from metals exposed to an aqueous system, is to circulate high concentrations of a chelant like ethylenediaminetetraacetic acid (EDTA) or nitrilotriacetic acid (NTA) to sequester and bind iron. This can be cost-prohibitive since it can result in large amounts of chelant consumed in heavily fouled systems as it functions stoichiometrically.

Just recently, several neutral-type on and off-line treatments were brought to the marketplace. These methods usually involve a much longer treatment time and may utilize tannins or similar-type compounds which can ultimately be used by microbes as a nutrient source creating a deposition problem. These compounds generally have only a 50% rate of conversion of insoluble $Fe^{3+}$ to a more soluble form, $Fe^{2+}$ resulting in less than efficient cleaning. Moreover, a neutralizer or acid addition step requiring additional chemical cost and handling is generally necessary with the neutral cleaners to aid in iron oxide removal and pH control.

U.S. Pat. No. 3,527,609 discloses a two stage method of removing iron oxide: (1) adding an alkali metal salt or ammonium salt of amino polycarboxylic acid to a recirculating system while adjusting pH to 8–11 then (2) acidifying system water to pH to 4–5.5 with sulfuric acid to remove iron oxide. U.S. Pat. No. 5,466,297 explains a method for removing iron oxide and recycling ferrous/ferric compounds with the use of a citric acid-tannin and erythorbic acid blend while adjusting the pH of the cooling water system to a range of 1–5. Canadian Patent 1,160,034 teaches a method of removing iron oxide by adding 3–300 ppm of a sulfated glyceryl trioleate and 2-hepto-1-(ethoxy propionic acid) imidazoline into an acid cleaner. The multi-component product is then applied to maintain a pH of 1–6 to clean rust and other deposits in a cooling system.

SUMMARY OF THE INVENTION

This invention relates to a metal cleaner for an aqueous system comprising as a mixture:

(1) a carboxylic acid;

(2) a non chelating amine, preferably an alkanolamine;

(3) a chelating agent or an alkali metal or ammonium salt thereof; and (4) preferably a sulfur-containing polymer.

The metal cleaner is a liquid blend of components that displays excellent performance in removing metal oxides from metals in aqueous systems including industrial, commercial and marine applications. Aqueous systems that may benefit from treatment with this metal cleaner include open and closed recirculating cooling water systems as well as diesel engine cooling systems.

Iron oxides are effectively removed on-line or off-line, depending on the severity of the iron fouling, without subjecting the system metallurgy to acidic, corrosive pH levels. Additionally, the iron oxide that is removed is preferably dispersed and suspended in the bulk water so that redeposition on equipment surfaces is not likely to occur. The composition preferably contains a surfactant and solvent for penetrating, removing and dispersing organic contamination in the aqueous system as well.

The invention also relates to a method of removing corrosion products, such as rust and iron oxide deposits from metal surfaces which come into contact with an aqueous system. Examples of such metal surfaces include chiller systems, heat exchangers, auxiliary equipment and system piping using a unique cleaning formulation. The cleaners are particularly useful for cleaning the surfaces of iron and steel.

BEST MODE AND OTHER EMBODIMENTS OF THE INVENTION

The carboxylic acid used in the metal cleaner may be a mono-, di-, or polycarboxylic acid having a least two carbon atoms. Examples include, but are not limited to, acrylic acid, polyacrylic acid, polymethacrylic acid, acetic acid, hydroxyacetic acid, gluconic acid, formic acid and citric acid. Citric is the preferred carboxylic acid due to its commercial availability and economic feasibility.

The non chelating amine can be, for example, morpholine, cyclohexylamine, an ethylamine, or an alkanolamine. The preferred amine is an alkanolamine. Preferably, the alkanolamine is an ethanolamines such as monoethanolamine, diethanolamine, or triethanolamine. Triethanolamine is the preferred alkolamine due to the resultant amine-citrate salt formed by its neutralization with citric acid. The amine-citrate shows improved performance when compared to a salt formed by the neutralization of citric acid with sodium hydroxide.

The preferred chelating agents are chelating compounds such as amino polycarboxylic acids or an alkali metal salts thereof or ammonium salts thereof. Examples of such chelating compounds are ethylenediaminetetraacetic acid (EDTA), nitrilotriacetic acid (NTA), pentasodium diethylenetriaminepentaacetic and their salts. Alkali metal salts are preferred. The most preferred chelating agent is the sodium salt of EDTA.

The addition of a sulfur-containing polymer is highly preferred because this component retards the redeposition of corrosion products by dispersing them or suspending them in water. The sulfur-containing polymer can be any sulfonated polymer with a molecular weight between 100 and 50,000. The preferred polymer is AQUATREAT AR-540 available from Alco Chemical.

The amounts of the various components in the metal cleaner are as follows:

(a) from about 1 to about 40 parts of carboxylic acid, preferably from about 10 to about 20 parts;

(b) from about 15 to about 25 parts of alkanolamine, preferably from about 15 to about 20 parts;

(c) from about 1 to about 20 parts of a chelating agent, preferably from about 2 to about 5 parts;

(d) from about 0.5 to about 15 parts of a sulfonated polymer, preferably from about 1 about 10 parts; and (e) water, where said parts are based upon 100 parts metal cleaner including water.

The weight ratio of amine to carboxylic acid is from 0.25:1.0 to 25:1.0, preferably 0.75:3.0 to 3.0:1.0, most preferably 0.75:1.0 to 2.0:1.0. The weight ratio of chelating agent to carboxylic acid is from 50.0:1.0 to 20.0:1.0, preferably 10.0:1.0: to 1.0:1.0, most preferably 5.0:1.0 to 2.0:1.0. The weight ratio of the sulfonated polymer to carboxylic acid is from 50.0:1.0, preferably from 10.0:1.0, most preferably 1.5:1.0.

The formulation may also contain one or more surfactants. The surfactant may be anionic, cationic, amphoteric, nonionic and/or mixtures, except that mixtures of cationic and anionic surfactants should be avoided, and are used in amounts of 1 to 5 weight percent, based upon the weight of the metal cleaner. Additionally, the formulation may contain 0.1 to 1.0 weight percent, based upon the weight of the metal cleaner, of a corrosion inhibitor for soft metals, sodium hydroxide to provide product neutrality and 0.1 to 1.0 weight percent, based upon the weight of the metal cleaner, of an antifoam to inhibit any foam generated by the surfactants. The formulation may also contain from 1 to 5 weight percent, based upon the weight of the metal cleaner, of a water soluble solvent for penetrating, removing, emulsifying or dispersing organic contamination from the cooling system. Additionally, it may contain 0.1 to 1.0 weight percent, based upon the weight of the metal cleaner, of a corrosion inhibitor for soft metals, sodium hydroxide to provide product neutrality and 0.1 to 1.0 weight percent, based upon the weight of the metal cleaner, of an antifoam to inhibit any foam generated by the surfactants.

The metal cleaner is typically used by pumping it into the water system to be cleaned, for instance a cooling tower, where it is recirculated with the recirculating water of the cooling tower at a typical velocity of about 3 ft/second to 7 ft/second. The temperature of the metal to be cleaned is usually similar to the temperature of the water in the system to be cleaned, usually about 35° C. to 55° C. except if the metal is part of a heat exchanger in which case the metal could reach a temperature of 80° C. to 95° C. The cleaner is formulated to be effective at temperatures of 20° C. to 100° C. as well. Of course, higher temperatures result in quicker removal and cleaning. The cleaning preferably takes place at a pH of less than about 8.0, preferably from 5.0 to 7.5.

An effective amount of the metal cleaning composition needed to remove iron oxide deposition continuously in lightly fouled on-line systems ranges from 50–10000 ppm. The effective amount of the iron oxide remover necessary to clean heavily fouled systems in a practically short time ranges from 0.5–20%, preferably 1–10% (10,000–100,000 ppm).

Depending on system metallurgy and operating conditions, these higher concentrations may be used on-line or off-line. By off-line it is meant circulating the cooling water in the system to be cleaned without the process side heat load, so that in an open, recirculating system it is unnecessary to pass it through a cooling tower, or to reduce solids content by blowdown except as dictated by the cleaning process. This is usually done when the system is failing due to the heavy deposit or corrosion problems. The high concentration cleaning usually last for 24 hours to two weeks depending on the severity of the problem and whether heat, which will shorten the required time, is available.

EXAMPLES

Experiments were run to determine efficacy of the iron oxide removal formulations. The letter examples represent blanks or comparisons while the numbered examples are tests within the scope of this invention. Examples D–F and 7–12 show the effectiveness of the cleaners in on-line cleaning at a 10% concentration over a 14 day period at a temperature of about 23° C. to about 27° C. The metal cleaning formulations used in Examples F–E to 7–12 were as follows:

| | |
|---|---|
| A = | Blank (no metal cleaner). |
| B = | comparison cleaner, DREWGARD ® metal cleaner, which is a blend of TEA, ethoxylated soya amine, and surfactants having a pH = 12. |
| C = | blend of 15% citric acid, 20% TEA, 3% EDTA and surfactants having a pH = 8.96. |
| 1 = | blend of 23% citric acid, 20% AMP-95[1], 5% EDTA + surfactants having a pH = 5.5 |
| 2 = | blend of 15% citric acid, 13% AMP-95, 5% EDTA + surfactants having a pH = 5.5 |
| 3 = | blend of 15% citric acid, 20% TEA, 5% EDTA and surfactants having a pH = 6.3 |
| 4 = | blend of 15% citric acid, 20% TEA, 5% EDTA and surfactants having a pH = 5.5 |
| 5 = | blend of 3.6% citric acid, 25% EDTA having a pH = 5.9 |
| 6 = | blend of 15% citric acid, 20% TEA, EDTA, copolymer + surfactants having a pH = 6.1 |

[1]2-amino-methyl-proponal (95% active).

The experimental protocol was such that mild steel C-1010 coupons were rusted for a period of two to four weeks to develop a thick and heavy iron oxide deposit. After rusting, the coupons were dried at 25° C. for one week to strongly bind the iron oxide to the metal substrate. The rusted coupons were then employed in iron oxide removal evaluations using a laboratory shaker. At that time, the coupons were suspended in flasks containing tap water and a molybdate-based corrosion inhibitor. Then the respective metal cleaning treatments (A–C and 1–6) were added to the flasks and the flasks were placed in the laboratory shaker. The speed of the shaker was set to 150–160 rpm. Various test conditions were used to evaluate the effectiveness of the metal cleaners. The results are summarized in Table I.

After the cleaning period, the cleaning solutions were filtered through a 0.45 micron filter and analyzed to measure the dissolved filterable iron (dfe). The % iron oxide removal was also determined by weight reduction. Each sample was tested five times to determine statistically significant results.

Examples A–F and 7–12 show the effectiveness of the cleaners in on-line cleaning at a 10% concentration over a 14 day period at a temperature of about 23° C. to about 27° C. The results indicate that a significant improvement in metal cleaning is achieved when cleaners within the scope of the subject invention are used. Comparisons F shows that the pH of the cleaner is significant. Also note that in Example 10 and 12, 66% and 64.75 iron removal was achieved. This is several times the amount removed when compared to the existing available technology as seen by the competitive product (B). Not only was iron oxide removal better, but more importantly, the iron oxide removed is completely dispersed in the water as indicated by the dissolved iron levels (DFE) and not removed as chips. The dissolved iron levels were several times greater than those achieved by existing technologies.

Examples K–N and 15–16

Examples I–J and 15–16 illustrate the use of the metal cleaners at higher temperatures where the experiments simulate the procedure used to clean diesel engine jackets and loops in marine applications. The formulation for the metal cleaners used in Examples K–N and 15–16 are as follows:

| | |
|---|---|
| G = | blank (no metal cleaner). |
| H = | blend of citric acid, EDTA, and surfactants having a pH = 5.4, having no TEA. |
| I = | comparison product having a pH of 8.5 which is a blend of chelating agents. |
| J = | a comparison product having a pH of 6.0 which is a blend of surfactants and sequestrants. |
| 13 = | blend of citric acid, TEA, EDTA + surfactants; pH = 4.7 |
| 14 = | blend of citric acid, TEA, EDTA, polymer + surfactants having a pH = 5.5. |

TABLE I

EXAMPLES D–F and 7–12
ON-LINE CLEANER AT A 10% DOSAGE OVER 14 DAYS AT ABOUT 23° C. TO 27° C.

| EXAMPLE | METAL CLEANER | DOSAGE | pH (i) | pH (f) | dfe (ppm) | % Iron Oxide Removal |
|---|---|---|---|---|---|---|
| D | A | 0 | 7.85 | 7.71 | 0.1 | 1.7 |
| E | B | 10.0% | 5.90 | 7.50 | NA | 5.1 |
| F | C | 10.0% | 8.96 | 8.95 | 3.2 | 3.2 |
| 7 | 1 | 10.0% | 4.94 | 7.69 | NA | 38.3 |
| 8 | 2 | 10.0% | 4.96 | 8.17 | NA | 30.9 |
| 9 | 3 | 10.0% | 6.11 | 7.65 | 3806.0 | 17.2 |
| 10 | 4 | 10.0% | 5.10 | 7.13 | 6600.0 | 66.0 |
| 11 | 5 | 10.0% | 5.60 | 7.62 | 5287.0 | 30.1 |
| 12 | 6 | 10.0% | 6.31 | 7.21 | 5024.0 | 64.7 |

TABLE II

EXAMPLES K–N and 15–16
ON-LINE CLEANER AT A 10% DOSAGE OVER 24 HOURS
AT ABOUT 66° C.

| EXAMPLE | METAL CLEANER | DOSAGE | pH (i) | pH (f) | DFE (ppm) | % Iron Oxide Removal |
|---|---|---|---|---|---|---|
| K | G | 0 | 7.96 | 8.53 | <0.1 | 5.2 |
| L | H (no TEA) | 10.0% | 5.88 | 8.81 | NA | 16.4 |
| M | I | 10.0% | 7.88 | 9.09 | 621 | 7.9 |
| N | J | 10.0% | 5.73 | 8.52 | 1465 | 15.9 |
| 15 | 13 | 10.0% | 5.14 | 7.37 | 4313 | 71.1 |
| 16 | 14 | 10.0% | 5.12 | 7.09 | 5003 | 75.9 |

The laboratory study at higher temperatures simulated the procedure used to clean diesel engine jackets and loops in marine applications. Cleaning is accelerated and more complete with the use of formulations of this invention as shown by the high iron oxide removal percentages (>71%). Comparison Example J shows the need for TEA in the formulation.

Examples R–T and 20–22

Examples R–T and 20–22 show the effects of using the metal cleaner at a 1% dosage. The formulation for the metal cleaners used in Examples K–P and 20–22 are as follows:

O = blank (no metal cleaner).
P = Competitive product which is a blend of 7% phosphonate, surfactants, sodium sulfite, and caustic having a pH of 6.3.
Q = Competitive product L with TEA added in place of the caustic to a pH of 6.3.
17 = blend of 15% citric acid, 20% TEA, EDTA, and surfactants having a pH 5.5.
18 = blend of 15% citric acid, 20% TEA, EDTA, and surfactants having a pH = 6.3.
19 = blend of 15% citric acid, 20% TEA, EDTA, polymer + surfactants having a pH = 6.5.

The results are summarized in Table III.

TABLE III

Examples R–T and 20–22
ON-LINE CLEANING AT A 1% DOSAGE OVER 14 DAYS
AT ABOUT 23° C. TO ABOUT 27° C.

| EXAMPLE | METAL CLEANER | DOSAGE | pH (i)[2] | pH (f)[3] | DFE (ppm) |
|---|---|---|---|---|---|
| R | O | 0 | 7.89 | 7.49 | 0.1 |
| S | P | 1.0% | 6.32 | 7.08 | 255 |
| T | Q | 1.0% | 6.31 | 7.92 | 397 |
| 20 | 17 | 1.0% | 5.14 | 7.14 | 1490 |
| 21 | 18 | 1.0% | 6.34 | 7.99 | 765 |
| 22 | 19 | 1.0% | 6.34 | 7.97 | 830 |

[2]i = initial
[3]f = final

The results indicate that a significant amount of iron is dissolved with the citric acid/alkanolamine blends at 1% concentration when compared to the blank and the competitive product. An amount of alkanolamine was added to the competitive product in an effort to enhance performance and to verify the effectiveness of the TEA in removing iron. The data shows that the dissolved iron level was increased by over 55% with the use of TEA. The data also confirms the synergistic behavior between citric acid and TEA for solubilizing iron since the dissolved iron levels were approximately 3–6 times that of the competitive product.

We claim:

1. A process for removing corrosive deposits from a metal surface exposed to an aqueous system where said process comprises:

contacting an effective amount of a metal cleaner to a metal surface exposed to an aqueous system where the pH of said metal cleaner is 50 to 75 and said metal cleaner comprises:

(a) from about 1 to about 40 parts by weight of citric acid;

(b) from about 15 to about 25 parts by weight of an alkanolamine;

(c) from about 1 to about 20 parts by weight of EDTA, alkali metal salts thereof, and ammonium salts thereof, and (d) water, where said parts by weight are based upon 100 parts of metal cleaner, and whereby corrosive deposits are removed from said metal surface.

2. The process of claim 1 where the process is carried out a temperature of 20° C. to 100° C.

3. The process of claim 1 where the metal cleaned is selected from the group consisting of iron and steel.

4. The process of claim 3 where the corrosive deposit removed from the metal is iron oxide or rust.

5. The process of claim 1 where the process is carried out on-line.

6. The process of claim 1 where the process is carried out off-line.

7. The process of claim 1 which additionally contains a sulfur-containing polymer.

8. The process of claim 1 where the alkanolamine is triethanolamine.

9. The process of claim 1 wherein the metal cleaner comprises:

(a) from about 10 to about 20 parts by weight of a citric acid;

(b) from about 15 to about 20 parts by weight of triethanolamine;

(c) from about 1 to about 20 parts by weight of ethylenediaminetetraacetic acid;

(d) from about 0.5 to about 15 parts by weight of a sulfonated polymer; and (e) a surfactant.

* * * * *

UNITED STATES PATENT AND TRADEMARK OFFICE

CERTIFICATE OF CORRECTION

PATENT NO. : 6,156,129
DATED : December 5, 2000
INVENTOR(S) : Linda M. Hlivka et al.

It is certified that error appears in the above-identified patent and that said Letters Patent is hereby corrected as shown below:

Column 8,
Line 26, delete "50 to 75" and insert therefor -- 5.0 to 7.5 --.

Signed and Sealed this

Tenth Day of February, 2004

JON W. DUDAS
*Acting Director of the United States Patent and Trademark Office*